US007992990B2

(12) United States Patent
Yamashita et al.

(10) Patent No.: US 7,992,990 B2
(45) Date of Patent: Aug. 9, 2011

(54) RECORDING APPARATUS

(75) Inventors: Yoshiro Yamashita, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1184 days.

(21) Appl. No.: 11/716,926

(22) Filed: Mar. 12, 2007

(65) Prior Publication Data

US 2008/0062241 A1 Mar. 13, 2008

(30) Foreign Application Priority Data

Sep. 12, 2006 (JP) ..... 2006-246635

(51) Int. Cl.
*B41J 2/01* (2006.01)

(52) U.S. Cl. ..... 347/102

(58) Field of Classification Search ..... 347/102, 347/43, 95–96, 100, 103
See application file for complete search history.

(56) References Cited

FOREIGN PATENT DOCUMENTS

| | | |
|---|---|---|
| JP | 11-188858 | 7/1999 |
| JP | 2000-94654 | 4/2000 |
| JP | 2000-198185 | 7/2000 |
| JP | 2000-343808 | 12/2000 |
| JP | 2001-10114 | 1/2001 |
| JP | 2001-212956 | 8/2001 |
| JP | 2001-315426 | 11/2001 |
| JP | 2002-187240 | 7/2002 |
| JP | 2002-321443 | 11/2002 |
| JP | 2002-370347 | 12/2002 |
| JP | 2003-57967 | 2/2003 |
| JP | 2003-084578 | 3/2003 |
| JP | 2005-231106 | 9/2005 |
| JP | 2005-343049 | 12/2005 |

*Primary Examiner* — Lamson D Nguyen

(74) *Attorney, Agent, or Firm* — Fildes & Outland, P.C.

(57) ABSTRACT

The invention provides a recording apparatus comprising: an intermediate transfer body; a supplying unit supplying a curable solution containing a resin that is curable by external stimulation on the intermediate transfer body; an ejecting unit containing a recording material onto a layer to be cured formed by the curable solution supplied on the intermediate transfer body; a transferring unit transferring the layer to be cured on which the ink has been ejected to a recording medium from the intermediate transfer body; and a stimulation supplying unit supplying stimulation that cures the layer to be cured that has been transferred onto the recording medium.

10 Claims, 3 Drawing Sheets

RECORDING APPARATUS

CROSS-REFERENCE TO RELATED APPLICATION

This application is based on and claims priority under 35 USC 119 from Japanese Patent Application No. 2006-246635 filed Sep. 12, 2006.

BACKGROUND

1. Technical Field

The invention relates to a recording apparatus.

2. Related Art

One of methods of recording images, data, etc. using ink is the inkjet recording method. The theory of the inkjet recording method is to eject liquid or melted solid ink from a nozzle, a slit, or a porous film, etc. and to perform a recording on paper, cloth, film, etc. Various methods of ejecting ink are proposed such as ejecting ink using an electrostatic attraction force, a so-called charge controlling method, ejecting ink using vibration pressure of a piezo element, a so-called drop-on-demand method (a pressure pulse method), ejecting ink using a pressure generated by forming and growing air bubbles with high heat, a so-called thermal inkjet method, and recorded material of images and data with extremely high resolution may be obtained.

In the recording methods using ink, including this inkjet recording method, in order to perform a recording with a high image quality on various recording media such as a penetrating medium and a non-penetrating medium, a method of transferring to the recording medium after recording on an intermediate transfer body is proposed.

SUMMARY

According to an aspect of the invention, there is provided a recording apparatus: comprising an intermediate transfer body;

a supplying unit supplying a curable solution containing a resin that is curable by external stimulation on the intermediate transfer body;

an ejecting unit ejecting ink containing a recording material onto a layer to be cured formed by the curable solution supplied on the intermediate transfer body;

a transferring unit transferring the layer to be cured on which the ink has been ejected to a recording medium from the intermediate transfer body;

and a stimulation supplying unit supplying stimulation that cures the layer to be cured that has been transferred onto the recording medium.

BRIEF DESCRIPTION OF THE DRAWINGS

Exemplary embodiments of the present invention will be described in detail-based on the following figures, wherein.

DETAILED DESCRIPTION

The embodiments of the invention are explained below by referring to the figures. The same letterings are given to the members having substantially the same function throughout all figures, and repeated explanations may be omitted.

The First Exemplary Embodiment

Figure 1:
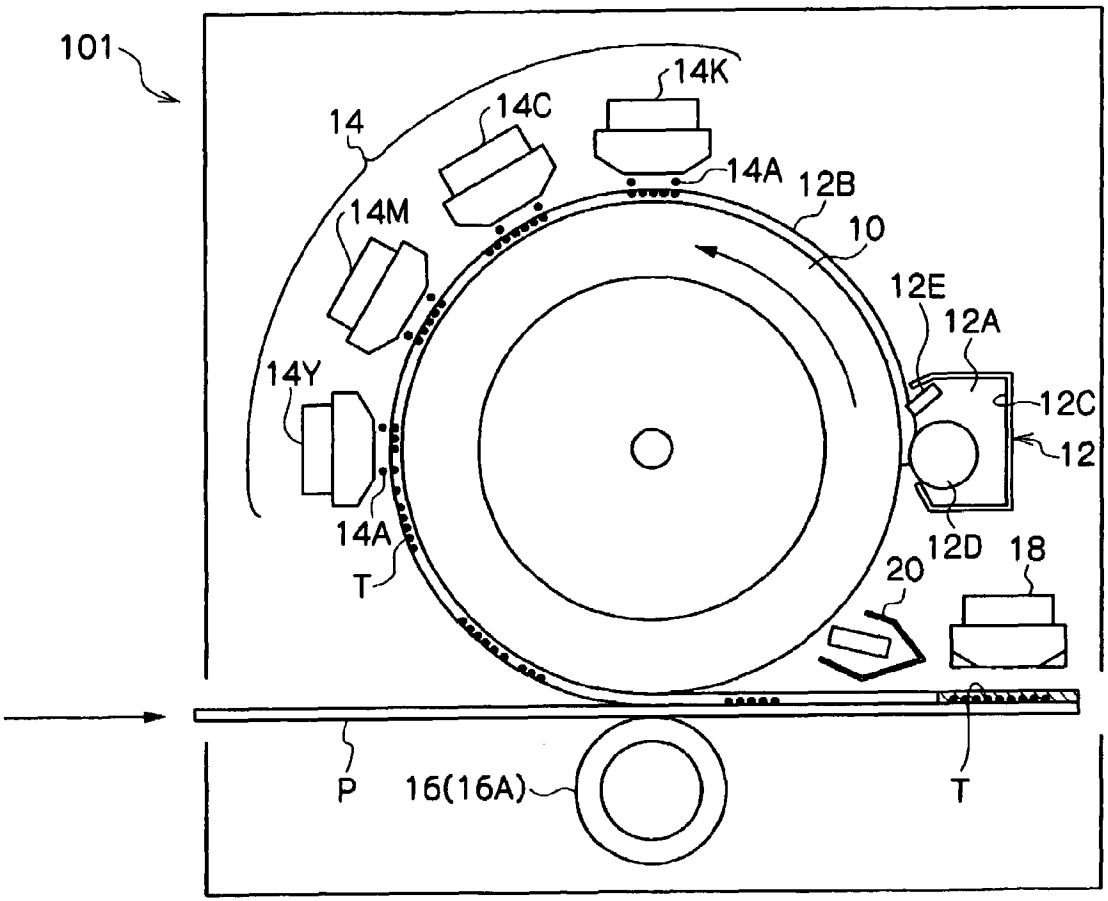
FIG. 1 is a configuration drawing showing the recording apparatus in the first exemplary embodiment.

FIG. 1 is a configuration figure showing the recording apparatus in the first exemplary embodiment.

A recording apparatus 101 in the first exemplary embodiment, as shown in FIG. 1, is configured by including an intermediate transfer drum 10, a solution supplying apparatus 12 supplying a curable solution 12A including a resin (hereinafter, referred to as a curable resin in some cases) capable of being cured by external stimulation (energy) on the intermediate transfer drum 10 and forming a layer to be cured 12B formed by the curable solution 12A, an inkjet recording head 14 forming an image T by ejecting an ink drop 14A on the layer to be cured 12B, a transfer apparatus 16 transferring the layer to be cured 12B where the image T is formed on a recording medium P by laying the recording medium P on top of the intermediate transfer drum 10 and adding pressure, and a stimulation supplying apparatus 18 supplying stimulation to cure the layer to be cured 12B transferred on the recording medium P.

A cleaning apparatus 20 to remove residue of the layer to be cured 12B remaining on the surface of the intermediate transfer drum 10 and to remove adhered substances such as foreign substances (paper dust of the recording medium P, etc.) besides the residue is arranged on the downstream side of the transfer apparatus 16 in the rotational direction of the intermediate transfer drum 10.

An example of the configuration of the intermediate transfer drum 10 includes a configuration having a cylindrical substrate and a surface layer to be applied on the surface of the substrate. The intermediate transfer drum 10 has a width (length in the axial direction) that is equal to or larger than the width of the recording medium P.

Examples of the material of the cylindrical substrate include aluminum, stainless steel (SUS), and copper.

Examples of the surface layer include various resins [for example, polyimide, polyamide imide, polyester, polyurethane, polyamide, polyether sulfone, fluorine-based resins, etc], and various rubbers (for example, nitrile rubber, ethylene-propylene rubber, chloroprene rubber, isoprene rubber, styrene rubber, butadiene rubber, butyl rubber, chlorosulfonated polyethylene, urethane rubber, epichlorohydrin rubber, acrylic rubber, silicone rubber, fluorine rubber, etc.) The surface layer may be a single layered configuration or may be a multi-layered configuration.

The solution supplying apparatus 12 is configured, for example, by including a supply roller 12D supplying the curable solution 12A to the intermediate transfer drum 10 of the layer to be cured 12B and a blade 12E defining the thickness of the layer to be cured 12B formed by the supplied curable solution 12A in a casing 12C storing the curable solution 12A.

The solution supplying apparatus 12 may have a configuration in which the supply roller 12D continuously makes contact with the intermediate transfer drum 10 or may be separated from the intermediate transfer drum 10. The solution supplying apparatus 12 may have the curable solution 12A supplied to the casing 12C from an independent solution supplying system (not shown in the Figures), and the supply of the curable solution 12A may not be interrupted.

Examples of the resin capable of being cured by external stimulation (energy) included in the curable solution 12A include an ultraviolet curable resin, an electron beam curable resin, and a thermosetting resin. The detail is explained later.

The solution supplying apparatus 12 is not limited to the above-described configuration, and an apparatus using a known method of supplying is applied (a method of coating such as coating with a bar coater, coating with a spraying method, coating with an inkjet method, coating with an air knife method; coating with a blade method, and coating with a roll method), etc.

The inkjet recording head 14 is configured by including a recording head of each color, for example, from the upstream side of the rotational direction of the intermediate transfer drum 10, a recording head 14K to eject black ink, a recording head 14C to eject cyan ink, a recording head 14M to eject magenta ink, and a recording head 14Y to eject yellow ink. The configuration of the recording head 14 is not limited to the above-described configuration, and it may be configured only with the recording head 14K or may be configured only with the recording head 14C, the recording head 14M, and the recording head 14Y.

Each of the recording heads 14 is desired to be a line-type inkjet recording head having a width equal to or lager than the width of the recording medium P. However, a conventional scan-type inkjet recording head may be used. The method of ejecting ink of each of the recording heads 14 is not limited as long as it is a method capable of ejecting ink such as a piezoelectric element driving type and a heating element driving type.

Each of the recording heads 14 is arranged in series in the order of the recording head 14K, the recording head 14C, the recording head 14M, and the recording head 14Y from the upstream side of the rotational direction of the intermediate transfer drum 10.

Each of the recording heads 14 is arranged in a way that the distance between the surface of the intermediate transfer drum 10 and the nozzle face of the head is about 0.3 to 0.7 mm for example. Each of the recording heads 14 is arranged in a way that the longitudinal direction crosses (desirably, at a right angle) with the rotational direction of the intermediate transfer drum.

The transfer apparatus 16 is configured by including a pressure roll 16A arranged to press against the intermediate transfer drum 10. The pressure roll 16A, for example, may be configured the same as the material configuration of the above-described intermediate transfer drum 10.

The stimulation supplying apparatus 18 is selected depending on the type of the resin included in the curable solution 12A to be applied. Specifically, for example, in the case of applying the ultraviolet ray curable resin, an ultraviolet irradiation apparatus radiating an ultraviolet ray to the curable solution (the layer to be cured formed by the curable solution) is selected as the stimulation supplying apparatus 18. In the case of applying the electron beam curable resin, an electron beam irradiation apparatus radiating an electron beam to the curable solution (the layer to be cured formed by the curable solution) is selected as the stimulation supplying apparatus 18. In the case of applying the thermosetting resin, a heat applying apparatus applying heat to the curable solution (the layer to be cured formed by the curable solution) is selected as the stimulation supplying apparatus 18.

Examples of the apparatus to be applied as the ultraviolet ray irradiation apparatus include a metal halide lamp, a high-voltage mercury lamp, an ultra-high voltage mercury lamp, a deep ultraviolet ray lamp, a lamp in which a mercury lamp is excited from outside using a microwave without electrodes, an ultraviolet laser, a xenon lamp, and a UV-LED.

The irradiation condition of the ultraviolet ray is not specifically limited as long as it is a condition capable of sufficiently curing the curable solution containing the ultraviolet ray curable resin (the layer to be cured formed by the curable solution), and may be selected depending on the type of the ultraviolet ray curable resin, the thickness of the layer to be cured, etc. An example of the condition includes the condition that an irradiation is for 2 seconds with a high-voltage mercury lamp of 120 W/cm output.

Examples of the electron beam irradiation apparatus include a scanning type and a curtain type, and the curtain type is an apparatus drawing out thermal electrons generated in a filament with a grid in a vacuum chamber, accelerating rapidly with a high voltage (for example, 70 to 300 kV) and making an electron stream, and discharging to the atmosphere side through a window foil. The wavelength of the electron beam is generally smaller than 1 nm, and the energy of the electron beam reaches into a few MeV. However, electron beams with the number of wavelengths of the electron beam on the order of pm and the energy of a few 10 to a few 100 keV are used.

The irradiation condition of the electron beam is not specifically limited as long as it is a condition capable of sufficiently curing the curable solution containing the electron beam curable resin (the layer to be cured formed by the curable solution), and may be selected depending on the type of the electron beam curable resin, the thickness of the layer to be cured, etc. An example of the condition includes the condition that the amount of the electron beam is in the 5 to 100 kGy level.

Examples of the apparatus to be applied as the heat applying apparatus include a halogen lamp, a ceramic heater, a nichrome-wire heater, a microwave heater, and an infrared ray lamp. A heating apparatus with an electromagnetic induction method may be applied as the heat applying apparatus.

The heat applying condition is not specifically limited as long as it is a condition capable of sufficiently curing the curable solution containing the thermosetting resin (the layer to be cured formed by the curable solution), and may be selected depending on the type of the thermosetting resin, the thickness of the layer to be cured, etc. An example of the condition includes the condition that the heating is performed in air at 200° C. for 5 minutes.

The sufficiently cured state in each case referred to as the state in which transfer does not occur when a permeable paper (plain paper) is laid on top of a coated curable resin and a load of 200 g is applied.

Any permeable medium (for example, plain paper, coated paper, etc.) and non-permeable medium (for example, art paper, resin film, etc.) may be applied as the recording medium P. The recording medium is not limited to these and includes other industrial products such as a semiconductor substrate.

The image recording process of the recording apparatus 101 in the embodiment is explained below.

In the recording apparatus 101 in the embodiment, the intermediate transfer drum 10 is rotationally driven, and the layer to be cured 12B is formed first by supplying the curable solution 12A to the surface of the intermediate transfer drum 10 by the solution supplying apparatus 12.

The thickness of the layer to be cured 12B is not specifically limited. However, examples include in the range of 1 to 50 μm and preferably 2 to 10 μm. In the case that the image concentration is low (the amount of ink fed is small (for example, 0.1 to 1.5 $g/m^2$)), it is desired to control the thickness of the layer to be cured 12B to be a minimum thickness necessary (for example, 1 to 5 μm), and in the case that the image concentration is high (the amount of ink fed is large (for example, 4 to 15 $g/m^2$)), it is desired to control it to be a thickness of 4 to 10 μm for example.

For example, when the thickness of the layer to be cured 12B is set to a degree that ink drops do not reach to the lowest layer of the layer to be cured 12B, a region where the ink does not exist in the layer to be cured 12B does not expose after the transfer of the recording medium, and the region where the ink drops do not exist functions as a protective layer after curing.

The ink drop 14A is ejected by the inkjet recording head 14, and the ink drop 14A is applied to the layer to be cured 12B supplied on the intermediate transfer drum 10. The inkjet recording head 14 applies the ink drop 14A to a predetermined position of the layer to be cured 12B based on the predetermined image information.

The ejection of the ink drop A by the inkjet recording head 14 is performed on the intermediate transfer drum 10 which is a rigid body. That is, the ejection of the ink drop A is performed on the layer to be cured 12B in a state that the surface of the drum has no flexure.

By interposing the recording medium P with the intermediate transfer drum 10 by the transfer apparatus 16 and adding pressure to the layer to be cured 12B, the layer to be cured 12B in which the image is formed by the ink drop 14A is transferred onto the recording medium P.

By curing the layer to be cured 12B with the stimulation supplying apparatus 18, the image T by the ink drop 14A is fixed on the recording medium P by the curable resin. Thus, a curable resin layer (image layer) including the image T by the ink drop 14A is formed on the recording medium P.

The residue of the layer to be cured 12B remained on the surface of the intermediate transfer drum 10 and foreign substances after the layer to be cured 12B was transferred to the recording medium P are removed by the cleaning apparatus 20, the layer to be cured 12B is formed by supplying the curable solution on the intermediate transfer drum 10 by the solution supplying apparatus 12 again, and the image recording process is repeated.

In the recording apparatus 101 in the embodiment, the image recording is performed as described above.

The Second Exemplary Embodiment

Figure 2:
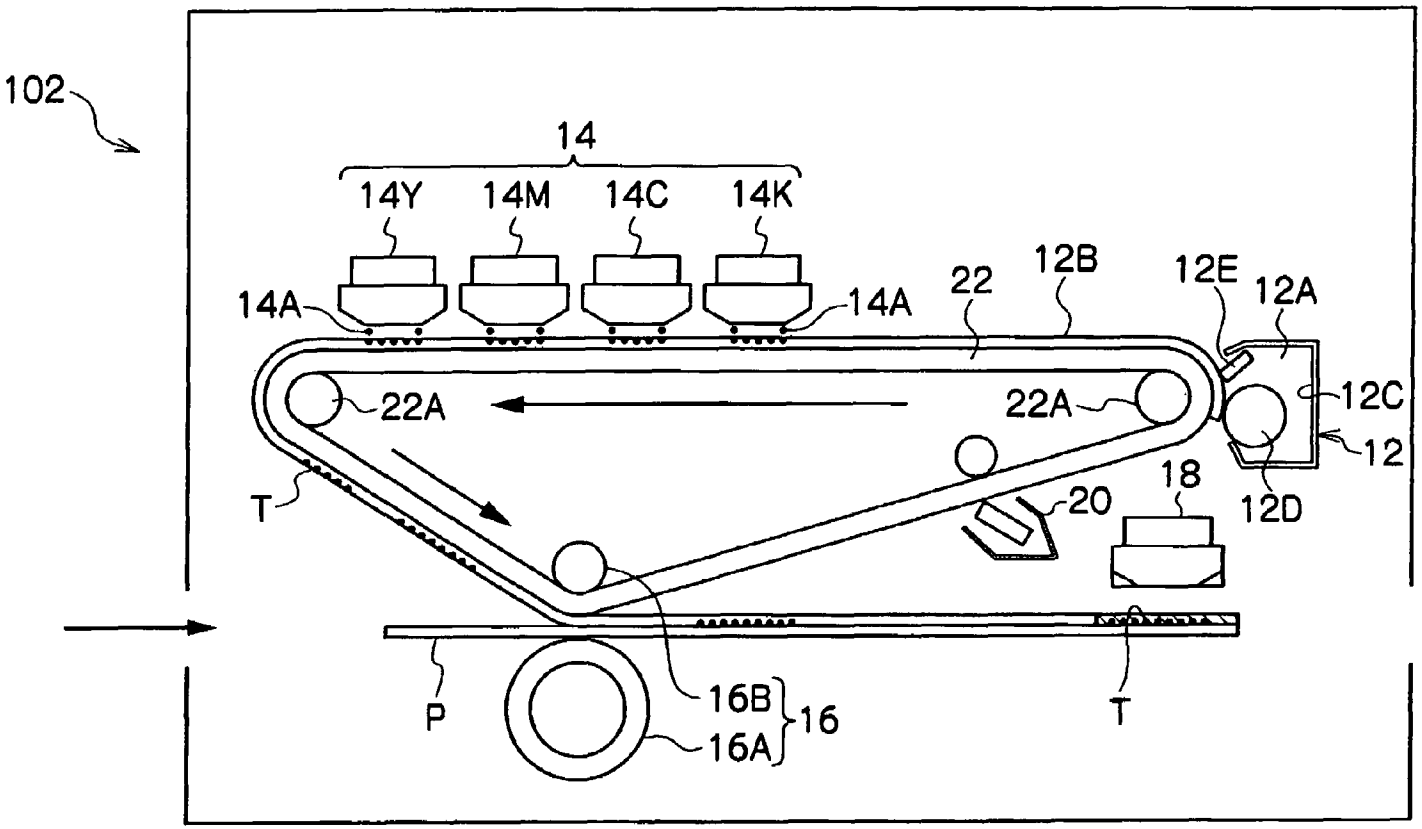
FIG. 2 is a configuration drawing showing the recording apparatus in the second exemplary embodiment.

FIG. 2 is a configuration drawing showing the recording apparatus in the second exemplary embodiment.

A recording apparatus 102 in the second exemplary embodiment, as shown in FIG. 2, is an embodiment in which an intermediate transfer belt 22 is arranged instead of the intermediate transfer drum 10 in the first exemplary embodiment.

The intermediate transfer belt 22 is arranged, for example, by being rotationally supported by two supporting rolls 22A and a pressure roll 16B (transfer apparatus 16) in a way that strain is applied from the inner peripheral surface side by the rolls and that rotation of the belt is possible.

The intermediate transfer belt 22 has a width (length in the axial direction) the same as or more than the width of the recording medium P.

The intermediate transfer belt 22 is configured, for example, with various resins [for example, polyimide, polyamide imide, polyester, polyurethane, polyamide, polyether sulfone, fluorine-based resins, etc.], and various rubbers (for example, nitrile rubber, ethylene-propylene rubber, chloroprene rubber, isoprene rubber, styrene rubber, butadiene rubber, butyl rubber, chlorosulfonated polyethylene, urethane rubber, epichlorohydrin rubber, acrylic rubber, silicone rubber, fluorine rubber, etc.). The intermediate transfer belt 22 may be configured with a metal material such as stainless steel. The intermediate transfer belt 22 may be a single layer configuration or may be a multi-layer configuration. The intermediate transfer belt 22 may have a surface layer of a mold-releasable material such as fluorine-based resins and silicone rubber.

Each of the recording heads 14 is arranged on a non-curved region in the intermediate transfer belt where strain is applied and rotationally supported, so that the distance between the surface of the intermediate transfer belt 22 and the nozzle surface of the head is for example about 0.7 to 1.5 mm.

The transfer apparatus 16 is configured by including a pair of pressure rolls 16A and 16B arranged to face each other with the intermediate transfer belt 22 between.

In the recording apparatus 102 in the embodiment, the ink drop 14A is ejected by the inkjet recording head 14 and the ink drop 14A is applied onto the layer to be cured 12B supplied on the intermediate transfer belt 22.

The ejection of the ink drop A by the inkjet recording head 14 is performed on the non-curved region in the intermediate transfer belt 22 where strain is applied and rotationally supported. That is, the ejection of the ink drop A is preformed on the layer to be cured 12B in a state that the surface of the belt has no flexure.

Beside these, it is the same as the first exemplary embodiment, and the explanation is omitted.

The Third Exemplary Embodiment

Figure 3:
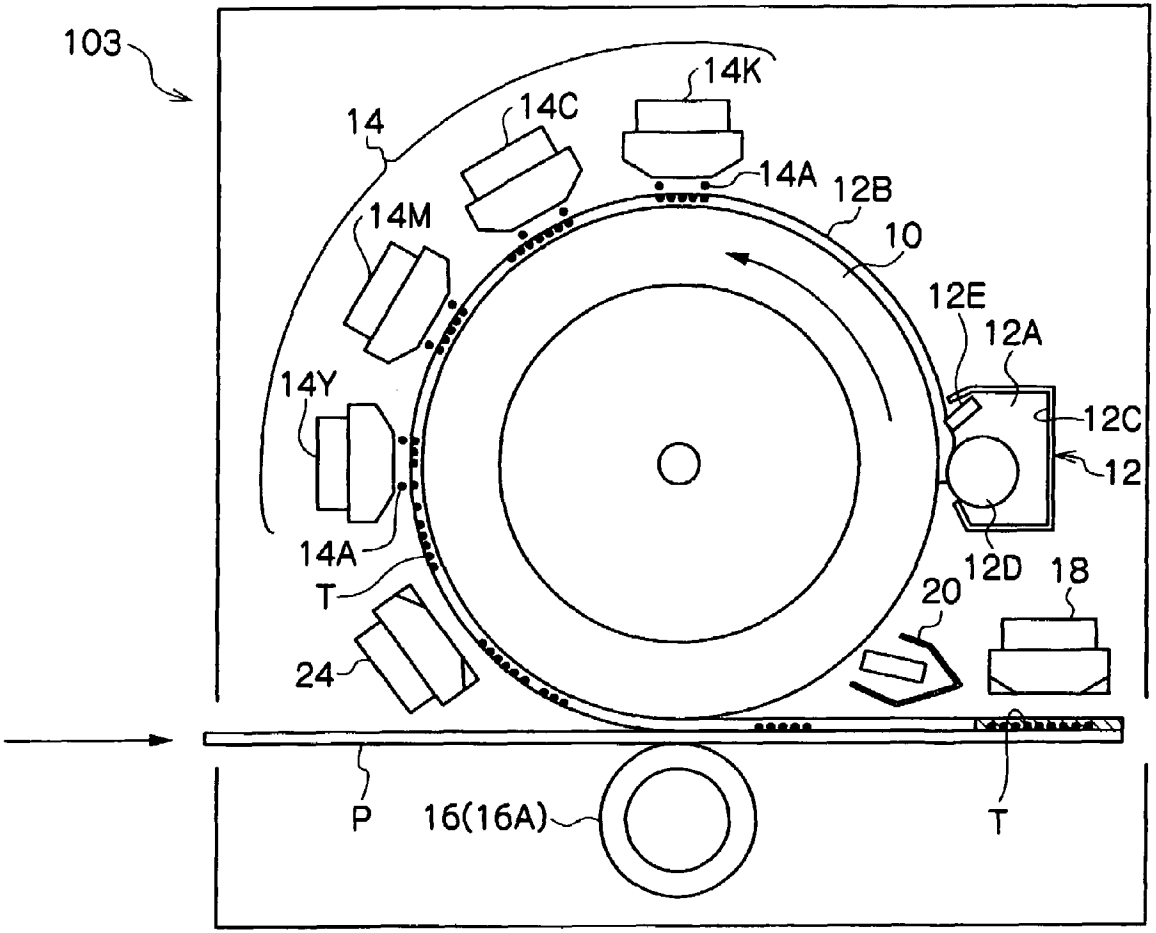
FIG. 3 is a configuration drawing showing the recording apparatus in the third exemplary embodiment.

FIG. 3 is a configuration drawing showing the recording apparatus in the third exemplary embodiment.

A recording apparatus 103 in the third exemplary embodiment, as shown in FIG. 3, is an embodiment in which the second stimulation supplying apparatus 24 is arranged additionally in the first exemplary embodiment supplying stimulation to partially-cure the layer to be cured 12B before the layer to be cured 12B on which the image by the ink drop 14A is formed is transferred on the recording medium P.

The second stimulation supplying apparatus 24 is, for example, arranged in the downstream side from the inkjet recording head 14 and in the upstream side from the transfer apparatus 16 in the rotational direction of the intermediate transfer belt 22.

The second stimulation supplying apparatus 24 is selected depending on the type of the resin included in the curable solution to be applied as in the same way as the stimulation supplying apparatus 18. Specifically, for example, in the case of applying the ultraviolet ray curable resin, an ultraviolet irradiation apparatus radiating an ultraviolet ray to the curable solution (by which the layer to be cured is formed) is applied as the second stimulation supplying apparatus 24. In the case of applying the electron beam curable resin, an electron beam irradiation apparatus irradiating the electron beam to the curable solution (the layer to be cured formed by the curable solution) is applied as the second stimulation supplying apparatus 24. In the case of applying the thermosetting resin, a heating apparatus heating the curable solution (the layer to be cured formed by the curable solution) is applied as the second stimulation supplying apparatus 24.

The ultraviolet ray irradiation condition, the electron beam irradiation condition, and the heating condition in the second stimulation apparatus 24 are not specifically limited as long as they are a condition in which the curable resin is partially-cured (in other words, a condition of insufficient curing), and are selected depending on the type of the resin, the thickness of the layer to be cured, etc.

One of the methods of confirming a "partially-cured" state is explained. When a permeable paper (for example, plain paper) is placed on the coated curable resin, a part of the uncured resin is transferred without applying a load. However, the case that the resin is not transferred to the paper at all when a load is not applied and a part of the resin is transferred when 200 g of the load is applied is considered to be a "partially-cured" state.

"Partially-cured" is referred to as a state in which the curable resin is cured more than when it is supplied to the intermediate transfer body, and it is not in a liquid state completely. When a permeable paper (for example, plain paper) is placed on the coated curable resin, a part of the uncured resin is transferred without applying a load. However, the case that the resin is not transferred to the paper at all when a load is not applied and a part of the resin is transferred when 200 g of the load is applied is considered to be a "partially-cured" state.

In the recording apparatus 103 in the embodiment explained above, the ink drop 14A is ejected by the inkjet recording head 14, and after applying the ink drop 14A to the layer to be cured 12B supplied on the intermediate transfer drum 10, the layer to be cured 12B is partially-cured by the second stimulation supply apparatus 24. Then, the layer to be cured 12B is transferred to the recording medium P by the transfer apparatus 16. At this transfer, the layer to be cured 12B is transferred in a partially-cured state, that is a state in which it has some degree of rigidity.

Beside these, it is the same as the first exemplary embodiment, and the explanation is omitted.

The curable resin (and the curable solution containing it) to be applied in the above-described embodiments are explained below.

The curable resin includes an ultraviolet curable resin, an electron beam curable resin, and a thermosetting resin. The ultraviolet curable resin is cured easily, the curing speed is faster than the others, and it is easy to use. The electron beam curable resin does not require a polymerization initiator, and control of coloration of the layer after curing is performed easily. The thermosetting resin is cured without any elaborate apparatus required. The curable resin is not limited to these, and curable resins which are cured by for example with moisture, oxygen, etc. may be applied.

The curable solution containing the curable resin has preferably a low volatility or a non-volatility at the room temperature (25° C.). Low volatility unit that the boiling point is 200° C. or more under atmospheric pressure. Non-volatility unit that the boiling point is 300° C. or more under atmospheric pressure. The explanation below is the same.

The ultraviolet curable resin includes an acrylic resin, a methacrylic resin, a urethane resin, a polyester resin, a maleimide resin, an epoxy resin, an oxetane resin, a polyether resin, and a polyvinylether resin. Its curable solution includes at least one kind of an ultraviolet curable monomer, an ultraviolet curable macromer, an ultraviolet curable oligomer, and an ultraviolet prepolymer. The curable solution includes also an ultraviolet polymerization initiator to make the ultraviolet curing reaction proceed as occasion demands.

The ultraviolet curable monomer includes an acrylate monomer, a methacrylate monomer, an epoxy monomer, an oxetane monomer, and a vinylether monomer. The macromer, the oligomer, and the prepolymer include products in which these monomers are polymerized at a predetermined degree of polymerization, epoxyacrylate, urethane acrylate, polyester acrylate, polyether acrylate, urethane methacrylate, and polyester methacrylate in which an acryloil group or a methacryloil group is added in a skeleton of epoxy, urethane, polyester, or polyether, etc.

The ultraviolet polymerization initiator includes a radical photo initiator such as acetophenone-based, benzophenone-based, benzoin ether-based, thioxanthone-based, acylphosphine oxide-based, peroxide-based, and titanocene-based compounds, an aryl diazonium salt, a diaryl iodonium salt, and a triaryl sulfonium salt.

The electron beam curable resin includes an acrylic resin, a methacrylic resin, a urethane resin, a polyester resin, a polyether resin, and a silicone resin. Its curable solution includes at least one kind of an electron beam curable monomer, an electron beam curable macromer, an electron beam curable oligomer, and an electron beam prepolymer.

The electron beam curable monomer, macromer, oligomer, and prepolymer include the same materials as the ultraviolet curable materials.

The thermosetting resin includes an epoxy resin, a polyester resin, a phenol resin, a melamine resin, a urea resin, and an alkyd resin. Its curable solution includes at least one kind of a thermosetting monomer, a thermo setting curable macromer, a thermo setting oligomer, and a thermosetting prepolymer. A curing agent may be added at polymerization. The curable solution may include a thermal polymerization initiator to make the thermosetting reaction proceed.

The thermosetting monomer includes polyalcohols such as phenol, formaldehyde, bisphenol A, epichlorhydin, cyanuric acid amide, urea, and glycerin, and acids such as phthalic anhydride, maleic anhydride, and adipic acid. The macromer, the oligomer, and the prepolymer include products in which these monomers are polymerized at a predetermined degree of polymerization, an epoxy prepolymer, and a polyester prepolymer.

The thermal polymerization initiator includes acids such as protic acid/Lewis acid, alkaline catalysts, and metal catalysts.

A component that fixes an ink component on the top of or inside of the layer to be cured may be included in any of the above-described curable solutions. Examples of the component that fixes include a component that absorbs the ink component (for example, the solvent), a component that adheres the ink component (for example, the colorant), and a component that aggregates or thickens the ink component (for example, the colorant). However, it is not limited to these.

The component that absorbs the ink component (for example, the solvent) includes inorganic materials such as almina and silica, and polymers such as polyvinyl acetamide, polyacrylic amide, polyacrylic acid, and denaturated cellulose. The ratio of the component is about in the range of 0 to 80% by mass.

The component that adheres the ink component (for example, the colorant) includes silica, almina, and zeolite. The ratio of the component is about in the range of 0 to 30% by mass.

The component that aggregates or thickens the ink component (for example, the colorant) includes aggregate agents of an inorganic electrolyte, organic acid, inorganic acid, organic amine, etc.

The inorganic electrolyte includes an alkali metal ion such as a lithium ion, a sodium ion, a potassium ion, a polyvalent metal ion such as an aluminum ion, a barium ion, a calcium ion, a copper ion, an iron ion, a magnesium ion, a manganese ion, a nickel ion, a tin ion, a titanium ion and a zinc ion, hydrochloric acid, hydrobromic acid, hydriodic acid, sulfuric acid, nitric acid, phosphoric acid, thiocyanic acid, and organic carboxylic acid such as acetic acid, oxalic acid, lactic acid, fumaric acid, citric acid, salicylic acid and benzoic acid, and organic sulfonic acid salts.

Specific examples include an alkali metal salt such as lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate, and a polyvalent metal salt such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogenphosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, iron iodide, iron sulfate, iron nitride, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogenphosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

Examples of the organic acid include arginine acid, citric acid, glycine, glutamic acid, succinic acid, tartaric acid, cysteine, oxalic acid, fumaric acid, phthalic acid, maleic acid, malonic acid, lycine, malic acid, the compounds represented by Formula (1), and the derivatives of the compounds.

Formula (1)

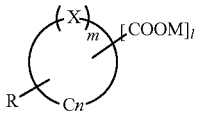

In the Formula (1), X represents O, CO, NH, $NR_1$, S or $SO_2$. $R_1$ represents an alkyl group and $R_1$ is preferably $CH_3$, $C_2H_5$ and $C_2H_4OH$. R represents an alkyl group and R is preferably $CH_3$, $C_2H_5$ and $C_2H_4OH$. R may be or may not be included in the Formula. X is preferably CO, NH, NR and O, and more preferably CO, NH and O. M represents a hydrogen atom, an alkali metal or amines. M is preferably H, Li, Na, K, monoethanol amine, diethanol amine or triethanol amine, is more preferably H, Na, and K, and is further preferably a hydrogen atom. n represents an integer of 3 to 7, preferably a heterocyclic ring having six-membered ring or five-membered ring, and more preferably the heterocyclic ring having five-membered ring. m represents 1 or 2. A compound represented by the Formula (1) is a saturated ring or an unsaturated ring as long as the compound is the heterocyclic ring. l represents an integer of 1 to 5.

Specific examples of the compound represented by the Formula (1) include the compound having furan, pyrrole, pyrroline, pyrrolidone, pyrone, pyrrole, thiophene, indole, pyridine, and quinoline structures, and furthermore, a compound having a carboxyl group as a functional group. Specific examples of the compound include 2-pyrrolidone-5-carboxylic acid, 4-methyl-4-pentanolide-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolide-3-carboxylic acid, 3-hydroxy-4-pyrone-2,6-dicarboxylic acid, 2-pyrone-6-carboxylic acid, 4-pyrone-2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophene carboxylic acid, 2-pyrrole carboxylic acid, 2,3-dimethyl pyrrole-4-carboxylic acid, 2,4,5-trimethyl pyrrole-3-propionic acid, 3-hydroxy-2-indole carboxylic acid, 2,5-dioxo-4-methyl-3-pyrroline-3-propionic acid, 2-pyrrolidine carboxylic acid, 4-hydroxyproline, 1-methylpyrrolidine-2-carboxylic acid, 5-carboxy-1-methyl pyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methyl nicotinic acid, 2-quinoline carboxylic acid, 4-quinoline carboxylic acid, 2-phenyl-4-quinoline carboxylic acid, 4-hydroxy-2-quinoline carboxylic acid, and 6-methoxy-4-quinoline carboxylic acid.

Preferably, the organic acid includes citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, or the derivatives or salts of the compounds. More preferably, the organic acid includes pyrrolidone carboxylic acid, pyrone carboxylic acid, pyrrole carboxylic acid, furan carboxylic acid, pyridine carboxylic acid, coumalic acid, thiophene carboxylic acid, nicotinic acid, or the derivatives or salts of the compounds. Further preferably, the organic acid includes pyrrolidone carboxylic acid, pyrone carboxylic acid, furan carboxylic acid, coumalic acid, or the derivatives or salts of the compounds.

An organic amine compound may be any of a primary amine, secondary amine, tertiary amine, quaternary amine and the salts thereof. Specific examples include a tetraalkyl ammonium, alkylamine, benzalkonium, alkylpyridium, imidazolium, polyamine and their derivatives or salts. Specific examples include amyl amine, butyl amine, propanol amine, propyl amine, ethanol amine, ethyl ethanol amine, 2-ethyl hexyl amine, ethyl methyl amine, ethyl benzyl amine, ethylene diamine, octyl amine, oleyl amine, cyclooctyl amine, cyclobutyl amine, cyclopropyl amine, cyclohexyl amine, diisopropanol amine, diethanol amine, diethyl amine, di-2-ethylhexyl amine, diethylene triamine, diphenyl amine, dibutyl amine, dipropyl amine, dihexyl amine, dipentyl amine, 3-(dimethyl amino) propyl amine, dimethyl ethyl amine, dimethyl ethylene diamine, dimethyl octyl amine, 1,3-dimethyl butyl amine, dimethyl-1,3-propane diamine, dimethyl hexyl amine, amino butanol, amino propanol, amino propane diol, N-acetyl amino ethanol, 2-(2-amino ethyl amino)-ethanol, 2-amino-2-ethyl-1,3-propane diol, 2-(2-amino ethoxy) ethanol, 2-(3,4-dimethoxy phenyl)ethyl amine, cetyl amine, triisopropanol amine, triisopentyl amine, triethanol amine, trioctyl amine, triethyl amine, bis(2-aminoethyl)1,3-propane diamine, bis(3-aminopropyl)ethylene diamine, bis(3-aminopropyl)1,3-propane diamine, bis(3-amino propyl)methyl amine, bis(2-ethyl hexyl)amine, bis(trimethyl silyl)amine, butyl amine, butyl isopropyl amine, propane diamine, propyl diamine, hexyl amine, pentyl amine, 2-methyl-cyclohexyl amine, methyl-propyl amine, methyl benzyl amine, monoethanol amine, lauryl amine, nonyl amine, trimethyl amine, triethyl amine, dimethyl propyl amine, propylene diamine, hexamethylene diamine, tetraethylene pentamine, diethyl ethanol amine, tetramethyl ammonium chloride, tetraethyl ammonium bromide, dihydroxy ethyl stearyl amine, 2-heptadecenyl-hydroxyethyl imidazoline, lauryl dimethyl benzyl ammonium chloride, cetylpyridinium chloride, stearamid methyl pyridium chloride, a diaryl dimethyl ammonium chloride polymer, a diaryl amine polymer, and a monoaryl amine polymer.

More preferably, there are used triethanol amine, triisopropanol amine, 2-amino-2-ethyl-1,3-propanediol, ethanol amine, propane diamine, and propyl amine.

Among these aggregating agents, polyvalent metal salts ($Ca(NO_3)$, $Mg(NO_3)$, $Al(OH_3)$, a polyaluminum chloride, or the like) are preferable The aggregating agents may either be used alone or as a mixture of two or more kinds. Moreover, the content of the aggregating agent is preferably 0.01% by mass or more and 30% by mass or less.

The curable solution may include water or an organic solvent to dissolve or disperse the primary component that contributes the above-described curing reaction (monomers, macromers, oligomers, and prepolymers, polymerizarion initiators, etc.) The ratio of the primary component is, for example, 30% by mass or more, desirably 60% by mass or more, and more desirably 90% by mass or more.

The curable solution may include various colorants to control coloration of the layer after curing.

The viscosity of the curable solution is 5 mPa·s to 100000 mPa·s, desirably 10 mPa·s to 1000 mPa·s, and more desirably 15 mPa·s to 500 mPa·s. The viscosity of the curable solution is preferably higher than the viscosity of the ink.

The ink applied in the above-described embodiments are explained below.

Any of an aqueous ink including an aqueous solvent as a solvent and an oily ink including an oily solvent as a solvent is used as the ink. An ultraviolet curing type ink is also used as the ink. The ink is preferably a low-volatile or a non-volatile ink, and particularly preferably an oily ink.

An example of an aqueous ink includes an ink in which a water-soluble dye or a pigment is dispersed or dissolved in an aqueous solvent as a recording material. Examples of an oily ink include an ink in which an oil-soluble dye is dissolved in an oily solvent as a recording material and an ink in which a dye or a pigment is formed to be an inverse micelle and is dispersed as a recording material.

The recording material is explained. The recording material includes mainly a colorant. Any dye or pigment may be used as the colorant. However, a pigment is preferable. Any organic pigment or inorganic pigment may be used, and a black pigment includes carbon black pigments such as furnace black, lamp black, acetylene black, and channel black. Other than black and the three primary color pigments of cyan, magenta, and yellow, specified colors pigments such as red, green, blue, brown, and white, metallic gloss pigments such as gold and silver, extender pigments such as colorless and light colors, plastic pigments, etc. may be used. Pigments synthesized newly for the invention may also be used.

Moreover, particles prepared by fixing a dye or a pigment onto the surface of silica, alumina, polymer beads, or the like as the core, an insoluble lake product of a dye, a colored emulsion, a colored latex, or the like can also be used as a pigment.

Specific examples of the black pigment include Raven 7000, Raven 5750, Raven 5250, Raven 5000 Ultra II, Raven 3500, Raven 2000, Raven 1500, Raven 1250, Raven 1200, Raven 1190 ULTRA II, Raven 1170, Raven 1255, Raven 1080 and Raven 1060 (manufactured by Columbian Carbon Company); Regal 400R, Regal 330R, Regal 660R, Mogul L, Black Pearls L, Monarch 700, Monarch 800, Monarch 880, Monarch 900, Monarch 1000, Monarch 1100, Monarch 1300 and Monarch 1400 (manufactured by Cabot Corporation): Color Black FW1, Color Black FW2, Color Black FW2V, Color Black 18, Color Black FW200, Color Black S150, Color Black S160, Color Black S170, Printex 35, Printex U, Printex V, Printex 140U, Printex 140V, Special Black 6, Special Black 5, Special Black 4A and Special Black 4 (manufactured by Degussa Co.): and No. 25, No. 33, No. 40, No. 47, No. 52, No. 900, No. 2300, MCF-88, MA 600, MA 7, MA 8 and MA 100 (manufactured by Mitsubishi Chemical Co., Ltd.). However, the pigments are not restricted thereto.

While specific examples of the cyan color pigments include C.I. Pigment Blue-1, -2, -3, -15, -15:1, -15:2, -15:3, -15:4, -16, -22 and -60, the pigments are not restricted thereto.

While specific examples of the magenta color pigments include C.I. Pigment Red-5, -7, -12, -48, -48:1, -57, -112, -122, -123, -146, -168, -177, -184, -202, and C.I. Pigment Violet -19, the pigments are not restricted thereto.

While specific examples of the yellow color pigments include C.I. Pigment Yellow-1, -2, -3, -12, -13, -14, -16, -17, -73, -74, -75, -83, 93, -95, -97, -98, -114, 128, -129, -138, -151, -154 and -180, the pigments are not restricted thereto.

Here, in the case a pigment is used as the colorant, it is preferable to use a pigment dispersing agent in a combination thereof. As a usable pigment dispersing agent, a polymer dispersing agent, an anionic surfactant, a cationic surfactant, an amphoteric surfactant, a nonionic surfactant, and the like are exemplified.

As the polymer dispersing agent, a polymer having a hydrophilic structure part and a hydrophobic structure part can preferably be used. As the polymer having a hydrophilic structure part and a hydrophobic structure part, a condensation-based polymer and an addition polymer can be used. As the condensation-based polymer, known polyester based dispersing agents can be exemplified. As the addition polymer, addition polymers of monomers having an α,β-ethylenically unsaturated group can be exemplified. By copolymerizing optionally a monomer having an α,β-ethylenically unsaturated group having a hydrophilic group and a monomer having an α,β-ethylenically unsaturated group having a hydrophobic group in combination, a targeted polymer dispersing agent can be obtained. Moreover, a homopolymer of monomers having an α,β-ethylenically unsaturated group having a hydrophilic group can be used as well.

As the monomer having an α,β-ethylenically unsaturated group having a hydrophilic group, monomers having a carboxyl group, a sulfonic acid group, a hydroxyl group, a phosphoric acid group, or the like, such as acrylic acid, methacrylic acid, crotonic acid, itaconic acid, itaconic acid monoester, maleic acid, maleic acid monoester, fumaric acid, fumaric acid monoester, vinyl sulfonic acid, styrene sulfonic acid, sulfonated vinyl naphthalene, vinyl alcohol, acrylic amide, methacryloxy ethyl phosphate, bismethacryloxy ethyl phosphate, methacryloxy ethyl phenyl acid phosphate, ethylene glycol dimethacrylate, and diethylene glycol dimethacrylate can be exemplified.

As the monomer having an α,β-ethylenically unsaturated group having a hydrophobic group, styrene derivatives such as styrene, α-methylstyrene and vinyl toluene, vinyl cyclohexane, vinyl naphthalene, vinyl naphthalene derivatives, alkyl acrylate, alkyl methacrylate, phenyl methacrylate, cycloalkyl methacrylate, alkyl crotonate, dialkyl itaconate, dialkyl maleate and the like are exemplified.

Preferable examples of the polymer which is used as a polymer dispersant include styrene-styrene sulfonic acid copolymer, styrene-maleic acid copolymer, styrene-methacrylic acid copolymer, styrene-acrylic acid copolymer, vinylnaphthalene-maleic acid copolymer, vinylnaphthalene-methacrylic acid copolymer, vinylnaphthalene-acrylic acid copolymer, alkyl acrylate-acrylic acid copolymer, alkyl methacrylate-methacrylic acid copolymer, styrene-alkyl methacrylate-methacrylic acid copolymer, styrene-alkyl acrylate-acrylic acid copolymer, styrene-phenyl methacrylate-methacrylic acid copolymer, and styrene-cyclohexyl methacrylate-methacrylic acid copolymer. In addition, a monomer having a polyoxyethylene group or a hydroxyl group may be appropriately polymerized.

Examples of the above-described polymer dispersant include ones having a weight average molecular weight of 2000 to 50000.

These pigment dispersing agents may either be used alone or two or more kinds in combination. Although the addition amount of the pigment dispersing agent varies with the types of the pigments largely, in general, it is added at a ratio of 0.1 to 100% by mass in total with respect to the pigment.

A self-dispersible pigment in water can be used as a colorant. The self-dispersible pigment in water used in the present invention refers to the pigment having many water-solubilizing groups on the surface of the pigment, which can be dispersed in water without adding any polymer dispersant. The self-dispersible pigment in water is practically obtained by applying surface modification treatments such as an acid or a base treatment, a coupling agent treatment, a polymer graft treatment, a plasma treatment or a redox treatment on so-called usual pigments.

As a self-dispersible pigment in water, in addition to the surface-modified pigments described above, commercially available pigments such as Cab-o-jet-200, Cab-o-jet-300, IJX-157, IJX-253, IJX-266, IJX-273, IJX-444, IJX-55, and Cabot 260 (manufactured by Cabot Corporation), and Microjet Black CW-1 and CW-2 (manufactured by Orient Chemical Industries, Ltd.) may also be used as the self-dispersible pigment in water.

As the self dispersing pigment, a pigment having as a functional group at least a sulfonic acid, a sulfonate, a carboxylic acid, or a carboxylate on the surface thereof is preferable. A pigment having as a functional group at least a carboxylic acid, or a carboxylate on the surface thereof is more preferable.

The pigment coated with a resin may be used as the colorant. Such pigment is called as microcapsule pigments, which include commercially available microcapsule pigments manufactured by Dainippon Ink & Chemicals, Inc. and Toyo Ink MFG Co., Ltd. as well as microcapsule pigments prepared for use in the present invention.

Moreover, a resin dispersing type pigment with a polymer substance physically adsorbed or chemically bonded with the above-mentioned pigment can also be used.

In addition, the recording material includes dyes such as a hydrophilic anion dye, a direct dye, a cation dye, a reactive dye, polymer dyes, and oil-soluble dyes; wax powders, resin powders, and emulsions colored with dyes; a fluorescent dye and a fluorescent pigment; an infrared absorber; an ultraviolet absorber; magnetic bodies such as ferromagnetic bodies represented by ferrite and magnetite; semiconductors and photocatalysts represented by titanium oxide and zinc oxide; other organic and inorganic electron material particles.

The content (concentration) of the recording material is, for example, in the range of 5 to 30% by mass to the ink.

The volume average particle size of the recording material is for example in the range of 10 nm or more to 1000 nm or less.

The volume average particle size of the recording material denotes the particle size of the recording material itself, or when an additive such as a dispersing agent is adhered onto the recording material, the particle size with the additive adhered. In the invention, as the device for measuring the volume average particle size, MICROTRUCK UPA particle size analysis meter 9340 (produced by Leeds & Northrup Corp.) is used. The measurement is carried out with 4 ml of an ink for an inkjet placed in a measurement cell according to a predetermined measuring method. As the parameters to be inputted at the time of the measurement, the viscosity of the ink is inputted as the viscosity, and the density of the recording material is inputted as the density of the dispersion particles.

The aqueous solvent is explained. The aqueous solvent includes water, and especially ion-exchanged water, superpure water, distilled water, and ultrafiltration water are preferably used. A water-soluble organic solvent may be used along with the aqueous solvent. Polyhydric alcohols, polyhydric alcohol derivatives, a nitrogen-containing solvent, alcohols, a sulfur-containing solvent, etc. may be used as the water-soluble organic solvent.

Specific examples of the polyhydric alcohols as the water-soluble organic solvent include ethylene glycol, diethylene glycol, propylene glycol, butylene glycol, triethylene glycol, 1,5-pentanediol, 1,2-hexanediol, 1,2,6-hexanetriol, glycerin, trimethylolpropane, sugar alcohols such as xylitol, and sugars such as xylose, glucose, and galactose.

Specific examples of the polyhydric alcohol derivative include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and the ethylene oxide adduct of diglycerin.

Specific examples of the nitrogen-containing solvent include pyrrolidone, N-methyl-2-pyrrolidone, cyclohexyl pyrrolidone, triethanol amine. Specific examples of the alcohols include ethanol, isopropyl alcohol, butyl alcohol, and benzyl alcohol. Specific examples of the sulfur-containing solvent include thiodiethanol, thiodiglycerol, sulfolane, and dimethyl sulfoxide.

In addition, it is also possible to use propylene carbonate and ethylene carbonate as a water-soluble organic solvent.

It is preferable that at least one kind of water-soluble organic solvent is used. The content of the water-soluble organic solvent to be used is 1% by mass or more and 70% by mass or less.

Next, the oily solvent will be explained. Organic solvents such as aliphatic hydrocarbons, aromatic hydrocarbons, alcohols, ketones, esters, ethers, glycols, nitrogen-containing solvents, and vegetable oils may be used as the oily solvent. Examples of the aliphatic hydrocarbons include n-hexane, cyclohexane, methylhexane, n-octane, methylheptane, dimethylhexane, nonane, and decane, and may be paraffin-based solvents such as n-paraffin-based solvents such as Isopar, iso-paraffin-based solvents, and cyclopraffin-based solvent. The aromatic hydrocarbons include toluene, ethylbenzene, and xylene. The alcohols include methanol, ethanol, propanol, butanol, hexanol, and benzyl alcohol. The ketones include acetone, methylethylketone, pentanone, hexanone, heptanone, and cyclohexanone. The esters include methyl acetate, ethyl acetate, vinyl acetate, ethyl propionate, and ethyl butyrate. The ethers include diethylether, ethylpropylether, and ethylisopropylether. The glycols include ethylene glycol, diethylene glycol, propanediol, hexanediol, glycerin, and polypropylene glycol. Glycol derivatives such as ethylene glycol methylether, ethylene glycol ethylether, ethylene glycol butylether, diethylene glycol ethylether, and diethylene glycol butylether may be used as the solvent. The vegetable oils include drying oil, semidrying oil, and nondrying oil. The drying oil includes perilla oil, linseed oil, tung oil, poppy seed oil, walnut oil, safflower oil, and sunflower oil, the semidrying oil includes rapeseed oil, and the nondrying oil includes palm oil. The above-described solvents may be used alone or two kinds or more may be used in combination.

Next, other additives will be explained. A surfactant may be added to the ink.

As the kinds of the surfactants, various kinds of anionic surfactants, nonionic surfactants, cationic surfactants, and amphoteric surfactants, or the like are exemplified. Preferably, the anionic surfactants and the nonionic surfactants can be used.

Hereinafter, specific examples of the surfactant are mentioned. Examples of the anionic surfactant may include alkylbenzenesulfonic acid salt, alkylphenylsulfonic acid salt, alkylnaphthalenesulfonic acid salt, higher fatty acid salt, sulfuric acid ester salt of higher fatty acid ester, sulfonic acid salt of higher fatty acid ester, sulfuric acid ester salt and sulfonic acid salt of higher alcohol ether, higher alkylsulfosuccinic acid salt, polyoxyethylenealkyl ethercarboxylic acid salt, polyoxyethylenealkyl ethersulfuric acid salt, alkylphosphoric acid salt and polyoxyethylenealkyl etherphosphoric acid salt, preferably dodecylbenzenesulfonic acid salt, isopropylnaphthalenesulfonic acid salt, monobutylphenylphenol monosulfonic acid salt, monobutylbiphenylsulfonic acid salt, monobutylbiphenylsulfonic acid salt and dibutylphenylphenoldisulfonic acid salt.

Examples of the nonionic surfactant may include polyoxyethylene alkyl ether, polyoxyethylene alkylphenyl ether, polyoxyethylene fatty acid ester, sorbitan fatty acid ester, polyoxyethylene sorbitan fatty acid ester, polyoxyethylene sorbitol fatty acid ester, glycerine fatty acid ester, polyoxyethyleneglycerine fatty acid ester, polyglycerine fatty acid ester, sucrose fatty acid ester, polyoxyethylenealkylamine, polyoxyethylene fatty acid amide, alkylalkanol amide, polyethyleneglycolpolypropyleneglycol block copolymer, acetylene glycol and polyoxyethylene adduct of acetylene glycol, preferably polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylol amide, polyethyleneglycol polypropyleneglycol block copolymer, acetylene glycol and polyoxyethylene adduct of acetylene glycol.

In addition, silicone surfactants such as polysiloxaneoxyethylene adduct, fluorine-based surfactants such as perfluoroalkyl carboxylic acid salt, perfluoroalkyl sulfonic acid salt and oxyethylene perfluoroalkyl ether, biosurfactants such as spiculisporic acid, rhamnolipid and lysolecithin.

These surfactants may be used solely or as a mixture. The hydrophilic/hydrophobic balance (HLB) of the surfactant is preferably in the range of 3 to 20 in view of dissolving stability, or the like.

The amount of the surfactant to be added is preferably 0.001% by mass to 5% by mass, specifically preferably 0.01% by mass to 3% by mass.

Furthermore, additionally, various additives can be added to the ink, such as a permeating agent in order to adjust the permeation property, or polyethylene imine, polyamines, a polyvinyl pyrrolidone, a polyethylene glycol, an ethyl cellulose, and a carboxy methyl cellulose, in order to control the ink ejection property, and compounds of alkali metals such as a potassium hydroxide, a sodium hydroxide and a lithium hydroxide for adjusting the conductivity and the pH. As needed, a pH buffer, an antioxidant, a mildew preventing agent, a viscosity adjusting agent, a conductive agent, an ultraviolet ray absorbing agent, a chelating agent, or the like can be added as well.

Next, appropriate characteristics of the ink will be mentioned. First, it is preferable that the surface tension of the ink is in the range of from 20 mN/m to 45 mN/m.

Here, as the surface tension, the value measured under the conditions of 23° C., and 55% RH by the use of the WILLHERMY type surface tension meter (produced by Kyowa Kaimen Kagaku Corp.) is used.

The viscosity of the ink is in the range of 1.5 to 30 mPa·s, and desirably in the range of 1.5 to 20 mPa·s. The viscosity of the ink is preferably lower than the viscosity of the above-described curable solution.

Here, as the viscosity, the value measured at the temperature of 23° C. and at the shearing speed of 1,400 $s^{-1}$, using REOMAT 115 (produced by Contraves) as the measurement device is used.

The ink is not limited to the above-described configuration. Besides the recording materials, it may include for example functional materials such as a liquid crystal material and an electron material.

In the embodiment above, the ink drop 14A is ejected selectively-based on the image data from the inkjet head recording head 14 of each color of black, yellow, magenta, and cyan, and full-colored images are recorded on the recording medium P. However, it is not limited to the recording of the letters and the images on the recording medium. The apparatus in the invention may be applied generally to the liquid drop ejection (spray) apparatus used in industry.

EXAMPLES

The invention is specifically explained in detail by referring to the examples below. However, these examples do not limit the invention.

Example 1

Using the recording apparatus with the same configuration as the above-described first embodiment (refer to FIGS. 1 and 2), the layer to be cured is formed by supplying the curable solution to the intermediate transfer drum by the solution supplying apparatus, and the images are formed by ejecting each ink from the recording head onto the layer to be cured. After the layer to be cured is transferred to the recording medium by the transfer apparatus, the layer to be cured is cured by supplying stimulation by the stimulation supplying apparatus for printing, and the evaluation is performed. The condition is as follows.

- Intermediate transfer drum: in which a fluorine-based resin is coated on a steel pipe with an outer diameter of 500 mm (drum (process speed): 400 mm/s)
- Solution supplying apparatus: a gravure roll coater (layer thickness of the curable resin layer to be cured 10 μm)
- Each recording head: a recording head of a piezo method (resolution 600 dpi (dpi: number of dots per inch, below the same))
- Transfer apparatus (pressure roll): in which a fluorine-based resin is coated on a steel pipe with a diameter of 30 mm (pressing force against the intermediate transfer drum: line pressure 3 kgf/cm)
- Stimulation supplying apparatus: a high voltage mercury lamp (the irradiation intensity of the ultraviolet rays 80 W/cm)
- Recording medium: two kinds of art paper (OK Kinfuji) and plain paper (FX-P paper (manufactured by Fuji Xerox Co., Ltd.))

The curable solution and the ink of each color manufactured as follows are used.

-Curable Solution Containing an Ultraviolet Curable Resin-

Polyester acrylate: 20 parts by mass

Tripropylene glycol diacrylate: 62 parts by mass

Pentaerythritol tetraacyrlate: 15 parts by mass 2-hydroxy-2-methyl-1-phenyl-propane-1-one (a photopolymerization initiator): 3 parts by mass The viscosity is adjusted to 85 mPa·s by adding 1,6-hexanediol diacrylate and PEG600 diacrylate to the above-described composition, and the curable solution containing the curable resin is produced.

-Black Ink-

Bk pigment dispersing solution (Solsperse 13940 (manufactured by Noveon, Inc.: a dispersing agent) is added to carbon black and is dispersed in Isopar L) (pigment concentration 14% by mass): 50 parts by mass Isopar L (manufactured by Exxon Mobil Corporation): 24 parts by mass Ethyl oleate: 26 parts by mass The viscosity is adjusted by adding Isopar G (manufactured by Exxon Mobil Corporation) to the above-described composition, and a black ink is produced. The viscosity is 5.5 mPa·s.

-Cyan Ink-

Cyan pigment dispersing solution (Solsperse 16000 (manufactured by Noveon, Inc.: a dispersing agent) is added to a phthalocyanine pigment and is dispersed in Isopar M) (pigment concentration 12.5% by mass): 40 parts by mass Isopar M (manufactured by Exxon Mobil Corporation): 25 parts by mass Soy oil: 35 parts by mass The viscosity is adjusted by adding Isopar G to the above-described composition, and a cyan ink is produced. The viscosity is 8.4 mPa·s.

-Magenta Ink-

Magenta pigment dispersing solution (Solsperse 34750 (manufactured by Noveon, Inc.: a dispersing agent) is added to a quinacridone pigment and is dispersed in Isopar M) (pigment concentration 15% by mass): 35 parts by mass Isozole (manufactured by Nippon Oil Corporation): 13 parts by mass Soybean oil ethyl: 20 parts by mass Oleyl alcohol: 32 parts by mass The viscosity is adjusted by adding Isopar G to the above-described composition, and a magenta ink is produced. The viscosity is 7.8 mPa·s.

-Yellow Ink-

Yellow pigment dispersing solution (Disperbyk-101 (manufactured by BYK-Chemie: a dispersing agent) is added to Pigment Yellow 74 and is dispersed in Isopar G) (pigment concentration 20% by mass): 20 parts by mass Isopar M (manufactured by Exxon Mobil Corporation): 55 parts by mass Butyl oleate: 25 parts by mass The viscosity is adjusted by adding Isopar G to the above-described composition, and a yellow ink is produced. The viscosity is 5.8 mPa·s.

On any of the recording media (art paper (OK Kinfuji) and a plain paper (FX-P paper (manufactured by Fuji Xerox Co., Ltd.), below the same), the drying characteristics of the print is fast, the image quality is good, and the image storage stability is also excellent.

Comparative Example 1

The images are formed by ejecting the respective inks as in Example 1 on art paper (OK Kinfuji) and plain paper (FX-P paper manufactured by Fuji Xerox Co., Ltd.) directly from each recording head. The evaluation is performed in the same manner as Example 1. As a result, the ink does not dry on the art paper and the images are not fixed in Comparative Example 1.

Comparative Example 2

The printing is performed in the same manner as Example 1 except the transfer is performed on art paper (OK Kinfuji) and plain paper (FX-P paper manufactured by Fuji Xerox Co., Ltd.) after the images are formed by ejecting the ink directly on the intermediate transfer drum without supplying the curable solution containing the curable resin to the intermediate transfer drum. Of course, the stimulation supplying apparatus is not used (the ultraviolet irradiation is not performed). The evaluation is performed in the same manner as Example 1. As a result, the ink does not dry on the art paper and the images are not fixed also in Comparative Example 2.

Comparative Example 3

After the layer to be cured having a film thickness of 10 μm is formed by supplying the curable solution containing the curable resin directly on art paper (OK Kinfuji) and plain paper (FX-P paper manufactured by Fuji Xerox Co., Ltd.) by a gravure roll coater, the images are formed by ejecting each ink on the layer to be cured from the recording head. The layer to be cured is cured by the stimulation supply apparatus (ultraviolet irradiation). Except for these, printing is performed in the same manner as Example 1. The evaluation is performed in the same manner as Example 1. As a result, the images are fixed in Comparative Example 3. However, the ink does not dry completely and the stability of the images is insufficient.

Example 2

The printing is performed and the evaluation is performed in the same manner as Example 1 except the condition is changed as follows.

Solution supplying apparatus: a blade coater (thickness of the layer to be cured formed by the curable solution containing the curable resin 7 μm)

Curable solution containing curable resin: a curable solution containing the ultraviolet curable resins described below.

-Curable Solution Containing Ultraviolet Curable Resin-

Polyurethane acrylate: 60 parts by mass 1,6-hexanediol diacrylate: 20 parts by mass Trimethylolpropane triacrylate: 15 parts by mass Methylbenzoyl benzoate (a photopolymerization initiator): 5 parts by mass The viscosity is adjusted to 1200 mPa·s by adding decyl acrylate and epoxy acrylate to the above-described composition, and the curable solution containing the curable resin is produced.

On any of the recording media, the drying characteristics of the print is fast, the image quality is good, and the image storage stability is also excellent.

Example 3

The printing is performed and the evaluation is performed in the same manner as Example 1 except the condition is changed as follows.

Solution supplying apparatus: a rod coater (thickness of the layer to be cured formed by the curable solution containing the curable resin 5 μm)

Stimulation supplying apparatus: a high voltage mercury lamp (the irradiation intensity of the ultraviolet rays 120 W/cm)

Curable solution containing curable resin: a curable solution containing the ultraviolet curable resins described below.

-Curable Solution Containing Ultraviolet Curable Resin-

Dipropylene glycol diacrylate: 63 parts by mass

Pentaerythritol ethoxy tetraacrylate: 10 parts by mass

Glycerin propoxy triacrylate: 25 parts by mass 1-hydroxy-cyclohexyl-phenyl-ketone (a photopolymerization initiator): 2 parts by mass The viscosity is adjusted to 35 mPa·s by adding 1,6-hexanediol diacrylate and PEG400 diacrylate to the above-described composition, and the curable solution containing the curable resin is produced.

On any of the recording media, the drying characteristics of the print is fast, the image quality is good, and the image storage stability is also excellent.

Example 4

The printing is performed and the evaluation is performed in the same manner as Example 1 except the condition is changed as follows.

Solution supplying apparatus: an air knife coater (thickness of the layer to be cured formed by the curable solution containing the curable resin 12 μm)

Stimulation supplying apparatus: a metal halide lamp (the irradiation intensity of the ultraviolet rays 80 W/cm)

Curable solution containing curable resin: a curable solution containing the ultraviolet curable resins described below.

-Curable Solution Containing Ultraviolet Curable Resin-

Ethoxylated phenyl acrylate: 45 parts by mass 1,6-hexanediol diacrylate (HDDA): 44 parts by mass Trimethylolpropane triacrylate: 10 parts by mass Bis(2,4,6-trimethylbenzoyl)-phenylphosphine oxide (a photopolymerization initiator): 1 parts by mass The viscosity is adjusted to 15 mPas by adding decyl acrylate and PEG300 diacrylate to the above-described composition, and the curable solution containing the curable resin is produced.

On any of the recording media, the drying characteristics of the print is fast, the image quality is good, and the image storage stability is also excellent.

Example 5

Using the recording apparatus with the same configuration as the above-described second embodiment (refer to FIG. 2), the layer to be cured is formed by supplying the curable solution containing the curable resin to the intermediate transfer belt by the solution supplying apparatus, and the images are formed by ejecting each ink from the recording head on the layer to be cured. After the layer to be cured is transferred to the recording medium by the transfer apparatus, the layer to be cured is cured by supplying stimulation by the stimulation supplying apparatus, is printed, and the evaluation is performed. The condition is as follows. The evaluation is performed in the same manner as Example 1.

Intermediate transfer belt: in which the base material is a polyester resin and in which the releasability is improved by processing the surface of the base material with a fluorine resin (belt rotation speed (process speed): 600 mm/s)

Solution supplying apparatus: a spray coater (a layer thickness of the curable resin layer to be cured 15 μm)

Each recording head: a recording head of a piezo method (resolution 600 dpi)

Transfer apparatus (pressure roll): in which a fluorine-based resin is coated on a steel pipe with an outer diameter of 40 mm (pressing force against the intermediate transfer belt: line pressure 1.5 kgf/cm)

Stimulation supplying apparatus: a high voltage mercury lamp (the irradiation intensity of the ultraviolet rays 120 W/cm)

Recording medium: two kinds of art paper (OK Kinfuji) and plain paper (FX-P paper (manufactured by Fuji Xerox Co., Ltd.))

The curable solution containing the curable resin and the ink of each color manufactured as follows are used.

-Curable Solution Containing an Ultraviolet Curable Resin-

Polyester acrylate: 20 parts by mass

Epoxy acrylate: 30 parts by mass

Glycerine propoxy triacrylate: 30 parts by mass

Pentaerythritol tetraacyrlate: 10 parts by mass 1,2-octanedione, 1-[4-(phenylthio)phenyl]-,2-(o-benzoyloxime)(a photopolymerization initiator): 4 parts by mass Polyallylamine (colorant fixing agent): 6 parts by mass The viscosity is adjusted to 120 mPa·s by adding 1,6-hexanediol diacrylate and PEG400 diacrylate to the above-described composition, and the curable solution containing the curable resin is produced.

-Black Ink-

Bk pigment dispersing solution (Solsperse 5000 (manufactured by Noveon, Inc.: a dispersion aid) and Solsperse 17000 (manufactured by Noveon, Inc.: a dispersant) are added to carbon black and are dispersed in Isopar E) (pigment concentration 25% by mass): 30 parts by mass Isopar E (manufactured by Exxon Mobil Corporation): 37 parts by mass Rapeseed oil methyl: 33 parts by mass The viscosity is adjusted by adding Isopar G to the above-described composition, and a black ink is produced. The viscosity is 6.5 mPa·s.

-Cyan Ink-

Cyan pigment dispersing solution (Solsperse 5000 (manufactured by Noveon, Inc.: a dispersion aid) and Solsperse 17000 (manufactured by Noveon, Inc.: a dispersing agent) are added to a phthalocyanine pigment and are dispersed in Isopar L) (pigment concentration 12% by mass): 45 parts by mass Isopar L (manufactured by Exxon Mobil Corporation): 21 parts by mass Isopropyl linoleate: 34 parts by mass The viscosity is adjusted by adding Isopar G to the above-described composition, and a cyan ink is produced. The viscosity is 6.7 mPa·s.

-Magenta Ink-

Magenta pigment dispersing solution (Solsperse 22000 (manufactured by Noveon, Inc.: a dispersion aid) and Solsperse 17000 (manufactured by Noveon, Inc.: a dispersing agent) are added to Carmin 6B and are dispersed in ethyl oleate) (pigment concentration 16% by mass): 38 parts by mass Methyl linoleate: 40 parts by mass Ethyl oleate: 22 parts by mass The viscosity is adjusted by adding Isopar L (manufactured by Exxon Mobil Corporation) to the above-described composition, and a magenta ink is produced. The viscosity is 7.2 mPa·s.

-Yellow Ink-

Yellow pigment dispersing solution (Solsperse 22000 (manufactured by Noveon, Inc.: a dispersion aid) and Solsperse 17000 (manufactured by Noveon, Inc.: a dispersing agent) are added to Pigment Yellow 128 and are dispersed in Isopar G (manufactured by Exxon Mobil Corporation)) (pigment concentration 12% by mass): 50 parts by mass Isopar G (manufactured by Exxon Mobil Corporation): 25 parts by mass Stearyl alcohol: 25 parts by mass The viscosity is adjusted by adding Isopar E (manufactured by Exxon Mobil Corporatin) to the above-described composition, and a yellow ink is produced. The viscosity is 7.5 mPa·s.

On any of the recording media, the drying characteristics of the print is fast, the image quality is good, and the image storage stability is also excellent.

Example 6

The printing is performed and the evaluation is performed in the same manner as Example 5 except the condition is changed as follows.

Solution supplying apparatus: a transfer roll coater (thickness of the layer to be cured formed by the curable solution containing the curable resin 15 μm)

Stimulation supplying apparatus: a metal halide lamp (the irradiation intensity of the ultraviolet rays 120 W/cm)

Curable solution containing curable resin: in which a colloidal silica 5 parts by mass as a liquid absorbing material is added to a curable solution containing the ultraviolet curable resins used in Example 2.

Ink: each ink used in Example 1.

On any of the recording media, the drying characteristics of the print is fast, the image quality is good, and the image storage stability is also excellent.

Example 7

The printing is performed and the evaluation is performed in the same manner as Example 1 except the inks adjusted as follows are used.

-Black Ink-

Carbon black: 5 parts by mass

Styrene-acrylate-butylacrylate copolymer: 1.5 parts by mass

Glycerin: 25 parts by mass

Diethylene glycol monobutyl ether: 6 parts by mass

Oxyethylene oleyl ether: 0.5 parts by mass

The pH is adjusted by mixing the above-described composition and by adding pure water and NaOH, and the ink is obtained.

-Cyan Ink-

Copper phthalocyanine pigment: 4 parts by mass

Ethylmethacrylate-acrylic acid copolymer: 2 parts by mass

Diethylene glycol: 15 parts by mass

Glycerin: 15 parts by mass

Tetramethyldecynediol oxyethylene adduct: 2 parts by mass 1,3-butanediol: 4 parts by mass The pH is adjusted by mixing the above-described composition and by adding pure water and NaOH, and the ink is obtained.

-Magenta Ink-

Magenta pigment (C. I. Pigment Red 122): 6 parts by mass

Styrene-methacrylic acid-ethylhexylmethacrylate copolymer: 4 parts by mass

Ethylene glycol: 10 parts by mass

Glycerin: 15 parts by mass

Propylene glycol: 5 parts by mass

Tetramethyldecynediol oxyethylene adduct: 2.5 parts by mass

The pH is adjusted by mixing the above-described composition and by adding pure water and NaOH, and the ink is obtained.

-Yellow Ink-

Yellow pigment (C. I. Pigment Yellow 74): 5 parts by mass

Styrene-methacryllic acid-ethylmethacrylate copolymer: 3 parts by mass diethylene glycol: 15 parts by mass Triethylene glycol monobutylether: 8 parts by mass 1,2-hexanediol: 5 parts by mass Oxyethylene laurylether: 0.5 parts by mass The pH is adjusted by mixing the above-described composition and by adding pure water and NaOH, and the ink is obtained.

The viscosity of each of the above-described inks is black ink: 4.2 mPa·s, cyan ink: 4.8 mPa·s, magenta ink: 4.5 mPa·s, and yellow ink: 4.6 mPa·s.

On any of the recording media, the drying characteristics of the print is fast, the image quality is good, and the image storage stability is also excellent.

Example 8

The printing is performed and the evaluation is performed in the same manner as Example 5 except the condition is changed as follows.

Solution supplying apparatus: a spray coater (thickness of the layer to be cured formed by the curable solution containing the curable resin 12 μm)

Curable solution containing curable resin: a curable solution containing the ultraviolet curable resins described below.

Ink: each ink described below

-Curable Solution Containing an Ultraviolet Curable Resin-

The curable solution containing the ultraviolet curable resin used in Example 5 is prepared except that the viscosity is adjusted to 110 mPa·s by adding acrylate-methylacrylate copolymerized oligomer as a colorant fixing agent instead of polyallylamine and by adding 1,6-hexanediol diacrylate and PEG400 diacrylate.

-Black Ink-

Bk pigment dispersing solution (Solsperse 24000 (manufactured by Noveon, Inc.: a dispersant) is added to carbon black and is dispersed in Isopar E) (pigment concentration 15% by mass): 33 parts by mass Isopar G (manufactured by Exxon Mobil Corporation): 37 parts by mass Soybean oil methyl: 30 parts by mass The viscosity is adjusted by adding Isopar E (manufactured by Exxon Mobil Corporation) to the above-described composition, and a black ink is produced. The viscosity is 7.5 mPa·s.

-Cyan Ink-

Cyan pigment dispersing solution (Solsperse 24000 (manufactured by Noveon, Inc.: a dispersing agent) is added to a phthalocyanine pigment and is dispersed in Isopar L (manufactured by Exxon Mobil Corporation)) (pigment concentration 13% by mass): 50 parts by mass Isopar G (manufactured by Exxon Mobil Corporation): 24 parts by mass Ethyl linoleate: 26 parts by mass The viscosity is adjusted by adding Isopar E (manufactured by Exxon Mobil Corporation) to the above-described composition, and a cyan ink is produced. The viscosity is 6.8 mPa·s.

-Magenta Ink-

Magenta pigment dispersing solution (Solsperse 24000 (manufactured by Noveon, Inc.: a dispersing agent) is added to Carmin 6B and is dispersed in ethyl oleate) (pigment concentration 20% by mass): 30 parts by mass Ethyl linoleate: 40 parts by mass Methyl oleatel: 30 parts by mass The viscosity is adjusted by adding Isopar L (manufactured by Exxon Mobil Corporation) to the above-described composition, and a magenta ink is produced. The viscosity is 7.3 mPa·s.

-Yellow Ink-

Yellow pigment dispersing solution (Solsperse 24000 (manufactured by Noveon, Inc.: a dispersing agent) is added to Pigment Yellow 128 and is dispersed in Isopar G (manufactured by Exxon Mobil Corporation)) (pigment concentration 12% by mass): 57 parts by mass Isopar L (manufactured by Exxon Mobil Corporation): 23 parts by mass Stearyl alcohol: 20 parts by mass The viscosity is adjusted by adding Isopar G (manufactured by Exxon Mobil Corporatin) to the above-described composition, and a yellow ink is produced. The viscosity is 7.7 mPa·s.

On any of the recording media, the drying characteristics of the print is fast, the image quality is good, and the image storage stability is also excellent.

Example 9

The printing is performed and the evaluation is performed in the same manner as Example 5 except the condition is changed as follows.

Solution supplying apparatus: a spray coater (thickness of the layer to be cured formed by the curable solution containing the curable resin 19 μm)

On any of the recording media, the drying characteristics of the print is fast, the image quality is good, and the image storage stability is also excellent.

Example 10

The printing is performed and the evaluation is performed in the same manner as Example 5 except the condition is changed as follows.

Solution supplying apparatus: a bar coater (thickness of the layer to be cured formed by the curable solution containing the curable resin 25 μm)

Stimulation supplying apparatus: a high voltage mercury lamp (the irradiation intensity of the ultraviolet rays 80 W/cm)

Curable solution containing curable resin: a curable solution containing the ultraviolet curable resins described below.

-Curable Solution Containing an Ultraviolet Curable Resin-

The curable solution containing the ultraviolet curable resin used in Example 5 is prepared except that the viscosity is adjusted to 130 mPa·s by adding ethylacrylate-dimethylaminomethylacrylate copolymerized oligomer as a colorant fixing agent instead of polyallylamine and by adding 1,6-hexanediol diacrylate and PEG400 diacrylate.

On any of the recording media, the drying characteristics of the print is fast, the image quality is good, and the image storage stability is also excellent.

Example 11

The printing is performed and the evaluation is performed in the same manner as Example 1 except the condition is changed as follows.

Stimulation supplying apparatus: an electron beam irradiation apparatus (an area beam method) (acceleration voltage 100 keV, dose of the rays 50 kGy)

Curable solution containing curable resin: a curable solution containing the electron beam curable resins described below.

Polyester acrylate: 20 parts by mass

Triethylene glycol dimethacrylate: 40 parts by mass

Trimethylol propane trimethacrylate: 20 parts by mass

The viscosity is adjusted to 95 mPa·s by adding 1,6-hexanediol dimethacrylate and PEG600 diacrylate to the above-described composition, and the curable solution containing the curable resin is produced.

-Ink-

The inks used in Example 1 are used.

On any of the recording media, the drying characteristics of the print is fast, the image quality is good, and the image storage stability is also excellent.

Example 12

The printing is performed and the evaluation is performed in the same manner as Example 1 except the condition is changed as follows.

Stimulation supplying apparatus: an infrared lamp (heating temperature 80° C.)

Curable solution containing curable resin: a curable solution containing the thermosetting curable resins described below.

-Curable Solution Containing a Thermosetting Resin-

Unsaturated polyester resin: 95 parts by mass

Cumenehydroperoxide: 1.5 parts by mass

Styrene derivative is added to the above-described composition and the curable solution containing the thermosetting resin is produced.

On any of the recording media, the drying characteristics of the print is fast, the image quality is good, and the image storage stability is also excellent.

Example 13

Using the recording apparatus with the same configuration as the above-described third embodiment (refer to FIG. 3), the layer to be cured is formed by supplying the curable solution containing the curable resin to the intermediate transfer belt by the solution supplying apparatus, and the images are formed by ejecting each ink from the recording head on the layer to be cured. The layer to be cured is partially-cured by supplying stimulation by the second stimulation supplying apparatus. After the layer to be cured, which is partially-cured, is transferred to the recording medium by the transfer apparatus, the layer to be cured is cured by supplying stimulation by the stimulation supplying apparatus, is printed, and the evaluation is performed. The condition is as follows. The condition is the same as Example 1 except the second stimulation supplying apparatus is used, and the evaluation is performed in the same manner as Example 1.

Second stimulation supplying apparatus: a high voltage mercury lamp (the irradiation intensity of the ultraviolet rays 30 W/cm)

On any of the recording media, the drying characteristics of the print is fast, the image quality is good, and the image storage stability is also excellent.

From the above-described Examples and Comparative Examples, it is found that the images are capable of being formed on various recording media regardless of whether it is a non-permeable medium or a permeable medium in the Examples as compared with Comparative Examples.

All publications, patent applications, and technical standards mentioned in this specification are herein incorporated by reference to the same extent as if each individual publication, patent application, or technical standard was specifically and individually indicated to be incorporated by reference.

What is claimed is:

1. A recording apparatus comprising:

an intermediate transfer body;

a supplying unit supplying a curable solution containing a resin that is curable by external stimulation on the intermediate transfer body;

an ejecting unit ejecting ink containing a recording material onto a layer to be cured formed by the curable solution supplied on the intermediate transfer body;

a transferring unit transferring the layer to be cured on which the ink has been ejected to a recording medium from the intermediate transfer body;

and a stimulation supplying unit supplying stimulation that cures the layer to be cured that has been transferred onto the recording medium;

the resin that is curable by external stimulation being an ultraviolet curable resin. capable of being cured by an ultraviolet ray, and the stimulation supplying unit being an ultraviolet irradiation unit which irradiates the layer to be cured that has been transferred onto the recording medium with the ultraviolet ray.

2. The recording apparatus of claim 1, wherein the resin that is curable by external stimulation is an electron beam curable resin capable of being cured by an electron beam, and the stimulation supplying unit is an electron beam irradiation unit which irradiates the layer to be cured that has been transferred onto the recording medium with the electron beam.

3. The recording apparatus of claim 1, wherein the resin that is curable by external stimulation is a thermosetting resin capable of being cured by heat, and the stimulation supplying unit is a heating unit which heats the layer to be cured that has been transferred onto the recording medium.

4. The recording apparatus of claim 1, wherein the intermediate transfer body is an intermediate transfer belt.

5. The recording apparatus of claim 1, wherein the intermediate transfer body is an intermediate transfer drum.

6. The recording apparatus of claim 1, further comprising a second stimulation supplying unit that supplies stimulation to partially-cure the layer to be cured, which has been supplied on the intermediate transfer body and on which the ink has been ejected, on the intermediate transfer body.

7. The recording apparatus of claim 1, wherein the viscosity of the curable solution is 5 mPa·s to 100000 mPa·s.

8. The recording apparatus of claim 1, wherein the viscosity of the ink is lower than the viscosity of the curable solution.

9. The recording apparatus of claim 8, wherein the viscosity of the ink is 1.5 to 30 mPa·s.

10. The recording apparatus of claim 1, wherein the curable solution includes a component that fixes a component of the ink on or inside the layer to be cured.

* * * * *